US007414253B2

(12) United States Patent
Kleinschmidt et al.

(10) Patent No.: US 7,414,253 B2
(45) Date of Patent: Aug. 19, 2008

(54) EUV RADIATION SOURCE WITH HIGH RADIATION OUTPUT BASED ON A GAS DISCHARGE

(75) Inventors: Juergen Kleinschmidt, Goettingen (DE); Jens Ringling, Berlin (DE); Alexander Geier, Bovenden (DE)

(73) Assignee: XTREME technologies GmbH, Jena (DE)

( * ) Notice: Subject to any disclaimer, the term of this patent is extended or adjusted under 35 U.S.C. 154(b) by 216 days.

(21) Appl. No.: 11/504,957

(22) Filed: Aug. 16, 2006

(65) Prior Publication Data

US 2007/0045573 A1 Mar. 1, 2007

(30) Foreign Application Priority Data

Aug. 30, 2005 (DE) ..... 10 2005 041 567

(51) Int. Cl.
*H01J 65/04* (2006.01)

(52) U.S. Cl. ..... 250/504 R

(58) Field of Classification Search ..... 250/504 R, 250/493.1

See application file for complete search history.

(56) References Cited

U.S. PATENT DOCUMENTS 6,232,613 B1 5/2001 Silfvast et al.
6,389,106 B1 5/2002 Neff et al.
6,414,438 B1 7/2002 Borisov et al.
6,728,337 B2 4/2004 McGeoch
6,894,298 B2 * 5/2005 Ahmad et al. ..... 250/504 R

FOREIGN PATENT DOCUMENTS

| | | |
|---|---|---|
| DE | 102 19 173 | 11/2003 |
| DE | 102 60 458 | 7/2004 |
| EP | 1 460 886 | 9/2004 |
| WO | 03/087867 | 10/2003 |

* cited by examiner

*Primary Examiner*—Kiet T Nguyen
(74) *Attorney, Agent, or Firm*—Reed Smith LLP

(57) ABSTRACT

The invention is directed to an arrangement for generating EUV radiation based on a gas discharge plasma with high radiation emission in the range between 12 nm and 14 nm. It is the object of the invention to find a novel possibility for plasma-based radiation generation with high radiation output in the EUV spectral region (between 12 nm and 14 nm) which makes it possible to use tin as a work medium in EUV gas discharge sources for industrial applications. This object is met, according to the invention, in that a gas preparation unit is provided for defined control of the temperature and pressure of a tin-containing work medium and the flow thereof into the vacuum chamber in gaseous state. At least one thermally insulated reservoir vessel and a thermally insulated supply line are provided for transferring the gaseous tin-containing work medium from the gas preparation unit to the pre-ionization unit located inside the electrode housing.

20 Claims, 5 Drawing Sheets

EUV RADIATION SOURCE WITH HIGH RADIATION OUTPUT BASED ON A GAS DISCHARGE

CROSS-REFERENCE TO RELATED APPLICATIONS

This application claims priority of German Application No. 10 2005 041 567.9, filed Aug. 30, 2005, the complete disclosure of which is hereby incorporated by reference.

BACKGROUND OF THE INVENTION a) Field of the Invention

The invention is directed to an arrangement for the generation of EUV radiation based on a gas discharge plasma with a high radiation emission in the range between 12 nm and 14 nm. It is applied in industrial semiconductor fabrication and is conceived in particular for the process of EUV lithography under production conditions.

b) Description of the Related Art and Problems Addressed by the Invention

The generation of radiation from a gas discharge plasma has established itself in the field of plasma-based EUV radiation sources as a promising technology for excitation. Essentially, the following gas discharge concepts are known: Z-pinch arrangements with pre-ionization (e.g., U.S. Pat. No. 6,414,438 81), plasma focus arrangements (e.g., WO 03/087867 A2), hollow-cathode discharge arrangements e.g., U.S. Pat. No. 6,389,106 B1), star pinch discharge arrangements (e.g., U.S. Pat. No. 6,728,337 B1), and capillary discharge arrangements (e.g., U.S. Pat. No. 6,232,613 B1).

Further, there are variations of the above-named discharge types (e.g., hypocycloidal pinch discharge) and arrangements that combine elements of these different discharge types.

In all of these arrangements, a pulsed high-power discharge of >10 kA is ignited in a work gas of determined density, and a very hot (kT >30 eV), dense plasma is generated locally as a result of the magnetic forces and dissipated power in the ionized work gas.

Radiation sources must currently also satisfy the following specific requirements for use in semiconductor lithography under production conditions:

| | |
|---|---|
| 1. wavelength | 13.5 nm ± 1% |
| 2. radiation output in the intermediate focus | 115 W |
| 3. repetition frequency | 7-10 kHz |
| 4. Dose stability (averaged over 50 pulses) | 0.3% |
| 5. life of the collector optics | 6 months |
| 6. life of the electrode system | 6 months. |

For sometimes different reasons, only certain aspects of these requirements are satisfied by the arrangements mentioned above. Above all, the radiation output, its stability, and the lifetime of the electrode system are generally insufficient.

It has been shown especially that the required radiation outputs can only be achieved through an efficient emitter substance. Such substances which emit radiation in the desired spectral range between 13 nm and 14 nm in a particularly intensive manner are xenon, lithium, and tin.

However, as described e.g. in WO 03/087867 A2, the latter two materials are difficult to manage in plasma generation because they are solid under normal conditions and, in addition, exhibit substantial debris emission. Further, the disadvantages of a successful handling of lithium and tin consist in the following difficulties:

- in solid targets, discharge instabilities due to the formation of craters at the cathode;
- formation of deposits at the electrodes (leads to a short-circuiting of the electrode system after prolonged operation);
- with laser evaporation, poor dose distribution of the (preferably liquefied) target;
- with gaseous targets, requirement for a high-power furnace for generating the necessary vapor pressure (with pure tin: temperatures T>1000° C.).

OBJECT AND SUMMARY OF THE INVENTION

It is the primary object of the invention to find a novel possibility for plasma-based radiation generation with high radiation output in the EUV spectral region (in particular between 12 nm and 14 nm) which makes it possible to use tin as a work medium in EUV gas discharge sources for industrial application.

According to the invention, in an arrangement for the generation of EUV radiation based on a gas discharge plasma with high radiation emission in the range between 12 nm and 14 nm with two coaxial electrode housings enclosing a vacuum chamber, a first of which electrode housings is provided as a discharge chamber for the gas discharge for plasma generation and a second electrode housing having a pre-ionization arrangement for the generation of an initial ionization of a work gas that flows into the vacuum chamber, wherein a narrowed electrode collar of the second electrode housing projects into the first electrode housing, the above-stated object is met in that a gas preparation unit is provided for defined control of the temperature and pressure of a tin-containing work medium and the flow thereof into the vacuum chamber in gaseous state, wherein at least one thermally insulated reservoir vessel and a thermally insulated supply line are provided for transferring the gaseous tin-containing work medium from the gas preparation unit to the pre-ionization unit located inside the electrode housing.

In a first variant, the gas preparation unit advantageously has a thermal vessel for cooled holding of a liquefied work medium with a tin compound that is gaseous under normal conditions.

The gaseous tin compound that is used is preferably stannane ($SnH_4$). In this case, the thermal vessel is cooled to an internal temperature below −52.5° C., preferably to −100° C.

For continuous supply of the EUV-emitting gaseous tin compound, a reactor is advisably employed for producing the tin compound, this reactor being connected to the cooled thermal vessel which serves to liquefy the gaseous tin compound and acts as a buffer storage.

The gas preparation unit advantageously has, in addition, an inert-gas reservoir for mixing in an inert gas serving as an initiator for a homogeneous gas discharge of the gaseous tin compound. The inert-gas reservoir advisably contains at least one noble gas or nitrogen in order to generate a gas mixture of gaseous tin compound and inert gas.

At least one mass flow control unit (mass flow controller) is preferably arranged in front of the gas inlet into the electrode housing for controlling the supplied quantity ratios of the gas mixture of gaseous tin compound and inert gas. The thermally insulated supply line for the gaseous work medium is advisably connected to the second electrode housing by a gas inlet.

In order to minimize the debris emitted from the discharge chamber in direction of the first collector optics, it is also advantageous when the thermally insulated supply line for the gaseous work medium is connected to the first electrode housing via an annular gas inlet.

In a second variant, the gas preparation unit advantageously has a thermal vessel in the form of a thermally insulated furnace which is preferably provided for evaporating a liquid tin compound. In another construction, the furnace is used for storing in liquid state a tin compound that is solid under normal conditions and for evaporating this tin compound.

The furnace is advisably electrically heatable and has a thermostat for adjusting an evaporation temperature (adapted to the vacuum condition of the discharge chamber) of the utilized tin compound for a temperature range between 247° C. and 1400° C.

The furnace for the evaporation of the work medium is advisably arranged in the immediate vicinity of the second electrode housing and the gas inlet is connected directly to the pre-ionization unit. The gas inlet of the pre-ionization unit is preferably designed in such a way that the evaporated tin-containing work gas is introduced into the pre-ionization chamber of the second electrode housing between an insulator tube enclosing the pre-ionization electrode and an outer insulator tube of the pre-ionization unit. In order to prevent condensation of the tin-containing work gas, a heat-conducting layer, preferably made of copper, is advisably arranged in the gas inlet at least in the initial area of the outer insulator tube. In addition, a heat-conducting layer can also be arranged in the gas inlet on the insulator tube.

A tin compound suitable for the above-mentioned arrangement of the gas preparation unit is stannous chloride ($SnCl_2$). The furnace can advantageously be heated to a temperature between 247° C. and 623° C. to inject evaporated $SnCl_2$ into the vacuum chamber.

The basic idea of the invention stems from the consideration that tin, by reason of its intensive spectral lines between 12 nm and 14 nm, is best suited for substantially increasing the yield of EUV radiation. On the other hand, there is reluctance to use tin primarily because elementary tin, as a target in solid form, does not permit stable plasma generation (due to crater formation), liquid tin requires a continuous high-temperature bath to generate a sufficient vapor pressure, and laser evaporation from the liquid phase is also very demanding with respect to technology.

The invention overcomes these disadvantages in that the tin compounds, which can be changed to gaseous phase in a simple manner, are held in a temperature-managed, insulated manner prior to the pre-ionization of the work medium.

The arrangements according to the invention make it possible to achieve a plasma-based generation of radiation based on a gas discharge with high radiation output in the EUV spectral range (between 12 nm and 14 nm) which permits the use of tin as a work medium in gas discharge sources for semiconductor lithography.

The invention will be described more fully in the following with reference to embodiment examples.

DESCRIPTION OF THE PREFERRED EMBODIMENTS

Figure 1:
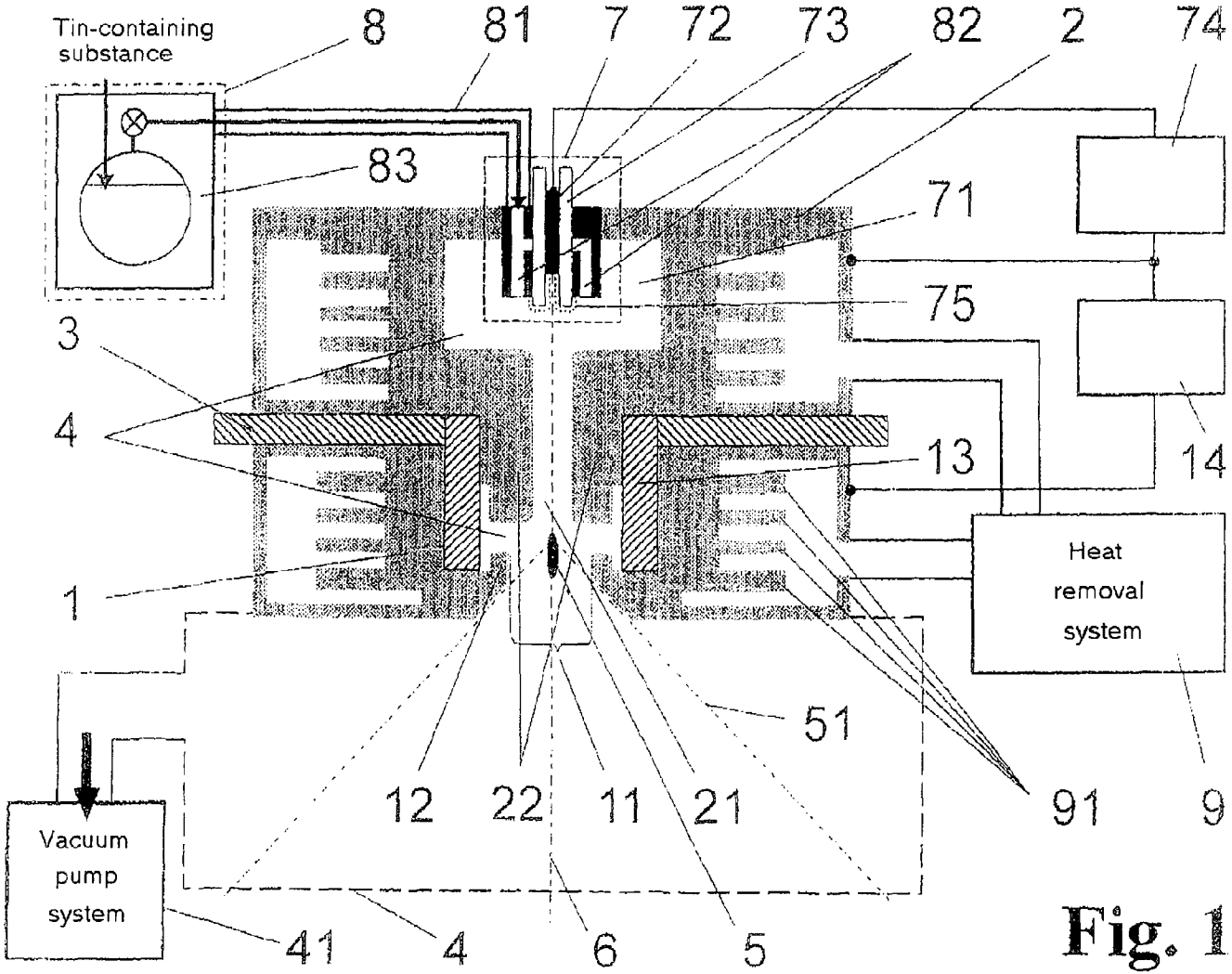
FIG. 1 shows a gas discharge source with a gas preparation unit for tin-containing work gas with a gas inlet on the cathode side and cooled electrode housings.

FIG. 1 shows the basic construction of the arrangement according to the invention. Without limiting generality, a Z-pinch gas discharge with pre-ionization is used, and a pulsed gas discharge takes place between the cathode and the anode. As in all of the other figures, the z-axis is identical to the axis of symmetry 6 of the discharge system extending vertically in the drawing plane. This discharge system is formed of a first electrode housing 1 (e.g., anode) and a second electrode housing 2 (e.g., cathode).

The electrode housings 1 and 2 are shown in FIG. 1 in a simplified schematic manner with a ribbed cooling arrangement. This type of cooling is usable only conditionally for the high-output EUV gas discharge sources described herein. The electrode housings 1 and 2 have rotationally symmetric cavities in the center, the pre-ionization chamber 71 for the pre-ionization of the work gas is located in the second electrode housing 2, and the discharge chamber for the main gas discharge is located in the first electrode housing 1. The two cavities are part of an entire vacuum chamber 4, since the generation of a plasma 5 emitting the desired EUV radiation 51 is confined to a vacuum in the pressure range of several Pascals (e.g., 5 to 30 Pa).

Since, in most cases the first electrode housing 1 for the main discharge and generation of the plasma 5 is connected as anode and the second electrode housing 2 for the pre-ionization is connected as cathode, the terms anode 1 and cathode 2 will be used for the sake of brevity in the following description without limiting generality.

In FIG. 1, the work gas required for the gas discharge is injected into the pre-ionization chamber 71 of the vacuum chamber 4 through a gas inlet 82 in the cathode 2. The vacuum chamber 4 is almost enclosed by the cathode 2 and has a narrowed outlet 21 into the interior of the anode 1. The narrowed outlet 21 is formed by an electrode collar 22 which is shielded from the cylindrical inner wall of the anode 1 by a tubular insulator 13 so that the gas discharge can take place between the electrode collar 22 of the cathode 2 and an electrode collar 12 of the anode 1, which electrode collar 12 is directed inward at the conical outlet 11. Due to the strong magnetic forces, the pre-plasma generated during the gas discharge contracts in the axis of symmetry 6 to form a dense, hot plasma 5 (Z-pinch).

A pre-ionization unit 7, preferably for a sliding discharge 75, is constructed in the cathode 2 to ionize the work gas that flows through a gas inlet 82. The sliding discharge 75 takes place over the end area of an insulator tube 73 which encloses the pre-ionization electrode 72. The pre-ionization electrode 72 on one side and the cathode 2 on the other side communicate with a pre-ionization pulse generator 74 for pulsed generation of the sliding discharge 75. Further, the cathode 2 is connected to a high-voltage pulse generator 14 which triggers the main gas discharge in cooperation with the anode 1.

The supply of the work medium, according to the invention, is effected in that a tin-containing substance in gaseous state is streamed into the pre-ionization chamber 71 under defined pressure via a suitably arranged gas inlet 82. The tin-containing work gas is made available by a gas preparation unit 8 in that a tin-containing substance in liquid phase is maintained close to the evaporation point in a thermal vessel, and a vapor pressure is accordingly generated through controlled temperature management and pressure regulation resulting in a sufficient flow of tin-containing work gas through the gas inlet 82 into the vacuum chamber 4 via a thermally and electrically insulated supply line 81.

The vacuum chamber 4 is maintained at a stationary vacuum level by means of a vacuum pump system 41 in spite of the work medium flowing in. To ensure continuous operation of pulsed plasma generation, the electrode housings 1 and 2 are cooled by means of heat exchanger structures 91 (shown in a simplified manner as ribs) in that the two electrode housings 1 and 2 are integrated in the cooling circuits of a heat removal system 9.

Figure 2:
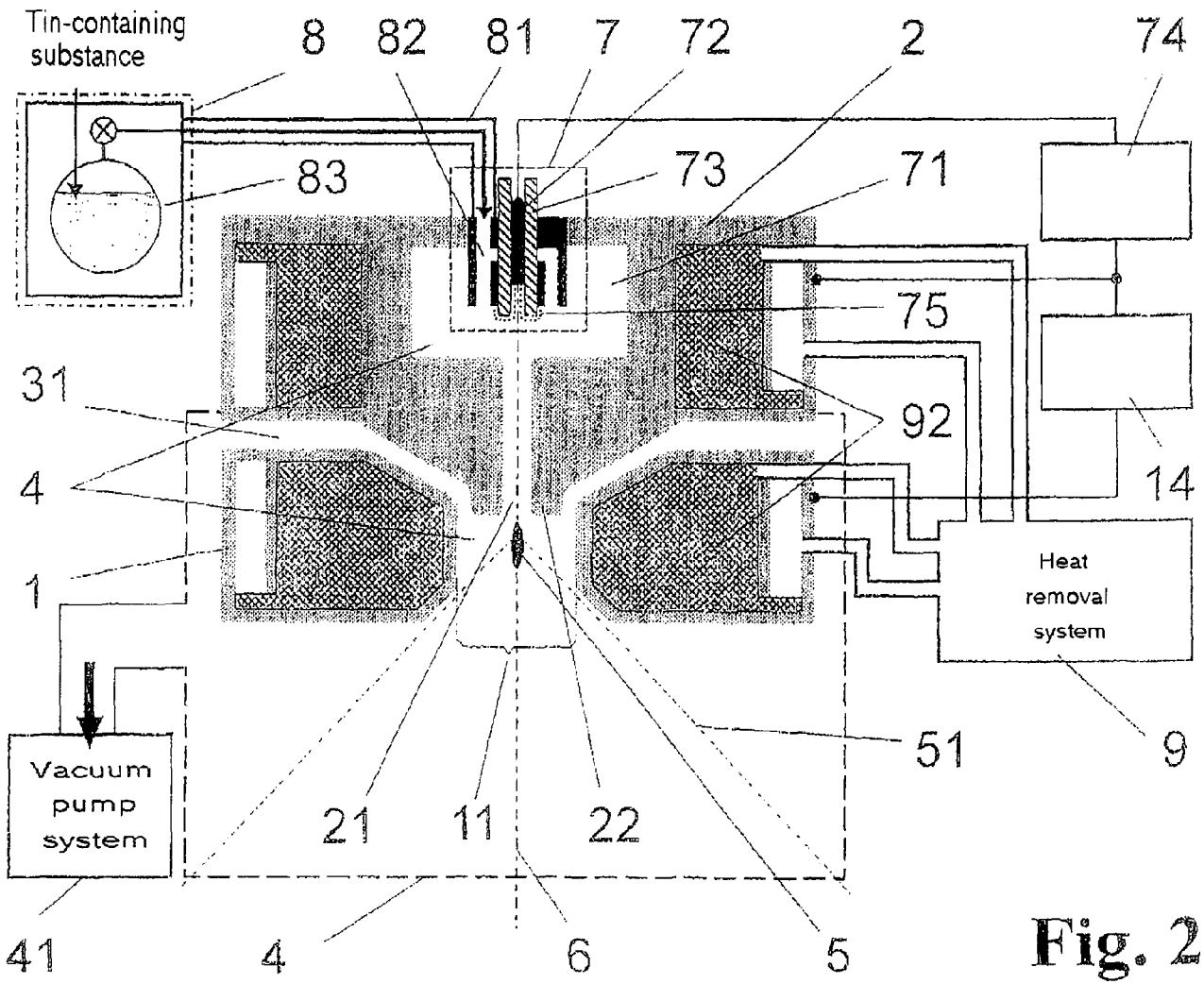
FIG. 2 shows a construction of the gas discharge source according to the invention for tin-containing work gas with a gas inlet on the cathode side, "porous metal" cooling, and vacuum insulation between the electrode housings.

The construction according to FIG. 2 shows an arrangement for an EUV gas discharge source which is modified from FIG. 1 and in which the configuration of the electrode housings 1 and 2 is modified in such a way that the anode 1 no longer has an almost completely closed inner space but, rather, the vacuum chamber 4 completely encloses the latter and forms a vacuum insulation layer 31 between the anode 1 and cathode 2. The preparation of gas and the supply of the tin-containing work gas initially remain unchanged, but all of the gas preparation variants described in detail in the following with reference to FIGS. 3 to 5 can be used.

In this example, the heat removal system 9 is optimized by introducing porous material in the electrode housings 1 and 2 in the cooling circuit as heat exchanger structures 91, which enables a faster transfer of heat and accordingly appreciably lowers the electrode temperatures in continuous operation.

Figure 3:
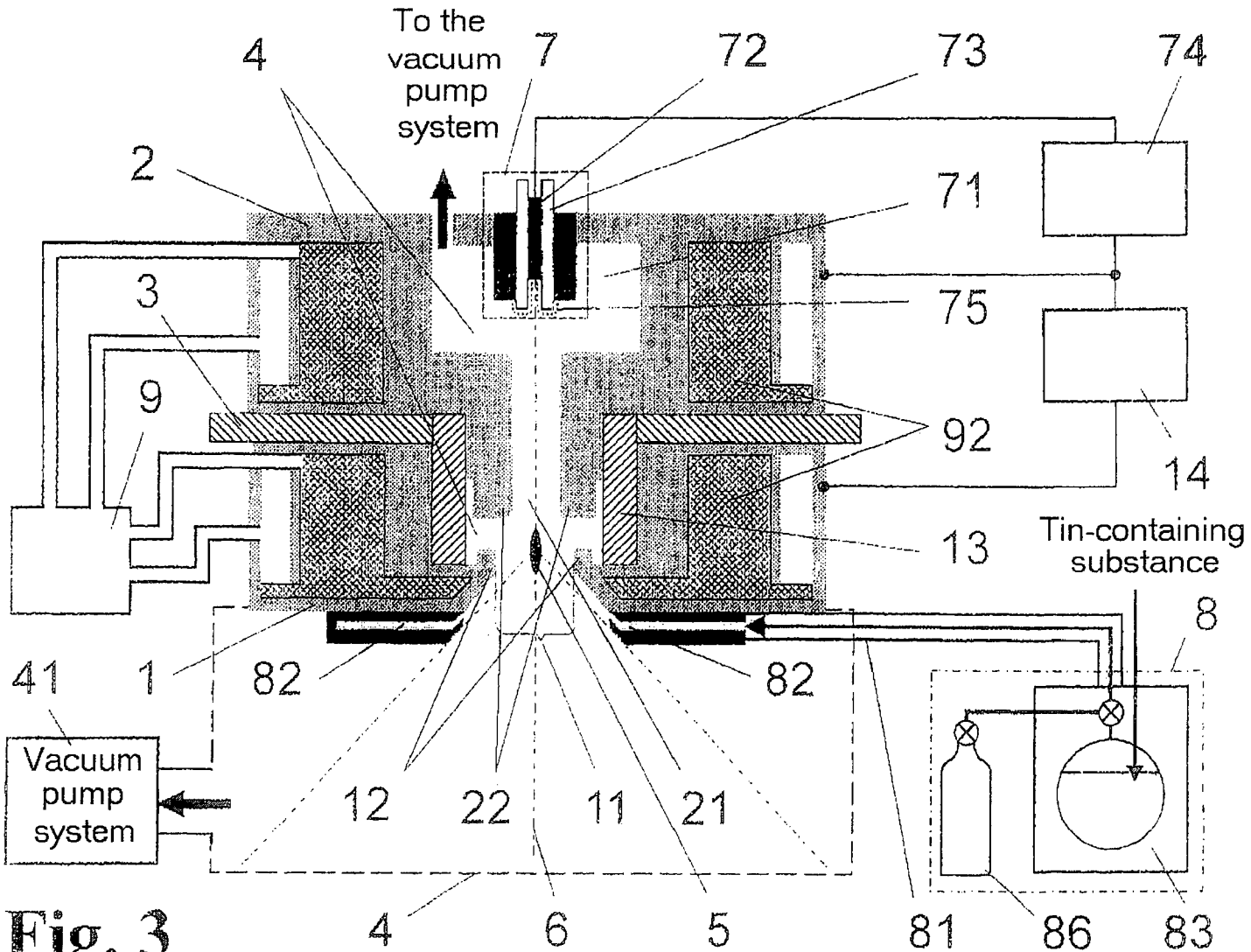
FIG. 3 shows another construction of the gas discharge source according to the invention for tin-containing work gas with a gas inlet on the anode side, "porous metal" cooling, and ceramic insulation of the electrodes.

In the embodiment example according to FIG. 3, the tin-containing work medium for the gas discharge is provided as a gas mixture of tin compound and inert gas. For this purpose, the gas preparation unit 8 contains a thermal vessel 83 with the tin-containing compound and an inert-gas reservoir 86 which generate the suitable gas mixture as work medium by means of controllable valves.

In the gas mixture, only the tin-containing component (e.g., $SnH_4$ gas) is the substance actually emitting the EUV radiation, and the inert gas which is mixed in additionally and which can be a noble gas (e.g., He, Ne, Ar) or nitrogen ($N_2$) serves as an initiator for a more homogeneous triggering of the gas discharge.

The second special feature of this constructional variant consists in that the work medium generated in this way is streamed in through an annular gas inlet 82 at the anode 1 in direction of the cathode 2, and an additional output to the vacuum pump system 41 is arranged at the back side of the cathode 2 which sucks in the gas mixture that is streamed in at the outlet 11 of the anode 1 in order to feed it into the pre-ionization chamber 71 of the pre-ionization arrangement. This has the advantage that when tin-containing work gases, e.g. $SnH_4$ or evaporated $SnCl_2$, are used according to the invention, they are not blown in direction of the collector optics and therefore cannot lead to deposits.

Figure 4:
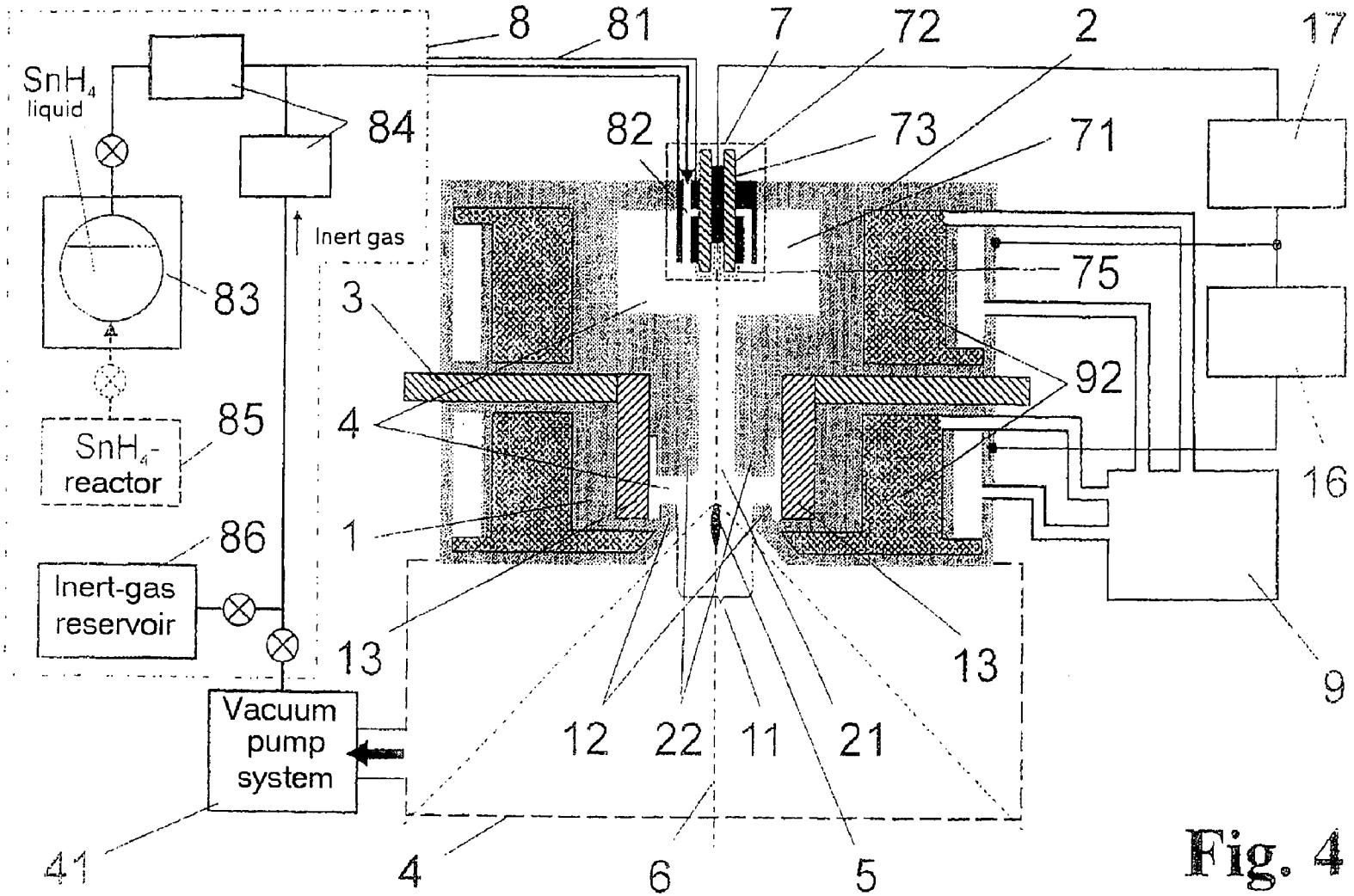
FIG. 4 shows a constructional variant of the invention with a gas preparation unit for liquid or liquefied tin-containing substances, particularly stannane ($SnH_4$)

In the arrangement shown in FIG. 4, $SnH_4$ gas is used as work medium, and the gas preparation unit 8 is outfitted in the following manner for this purpose. The thermal vessel 83 described above is operated as a cooling vessel and is maintained at a suitable temperature (approximately −95° C. for $SnH_4$) to achieve the necessary vapor pressure over the liquefied $SnH_4$. As is indicated in dashed lines as an option, the production of $SnH_4$ gas can be carried out continuously in a reactor 85 by methods known per se in order to ensure a continuous supply of $SnH_4$ gas. The cooled thermal vessel 83 is used for liquefaction and as a suitably temperature-controlled reservoir for maintaining the necessary vapor pressure for the tin-containing work gas component. An inert gas, preferably argon (or neon or nitrogen) is again mixed in as a second component of the work medium from an inert-gas reservoir 86.

The correct proportion of work gas components is adjusted by means of thermally insulated or suitably thermostatic lines 81 and mass flow controllers 84. The mass flow controllers 84 are particularly advantageous when—as is shown in FIG. 4—gas recovery from the vacuum pump system 41 is carried out and gas is also fed in at the same time.

Figure 5:
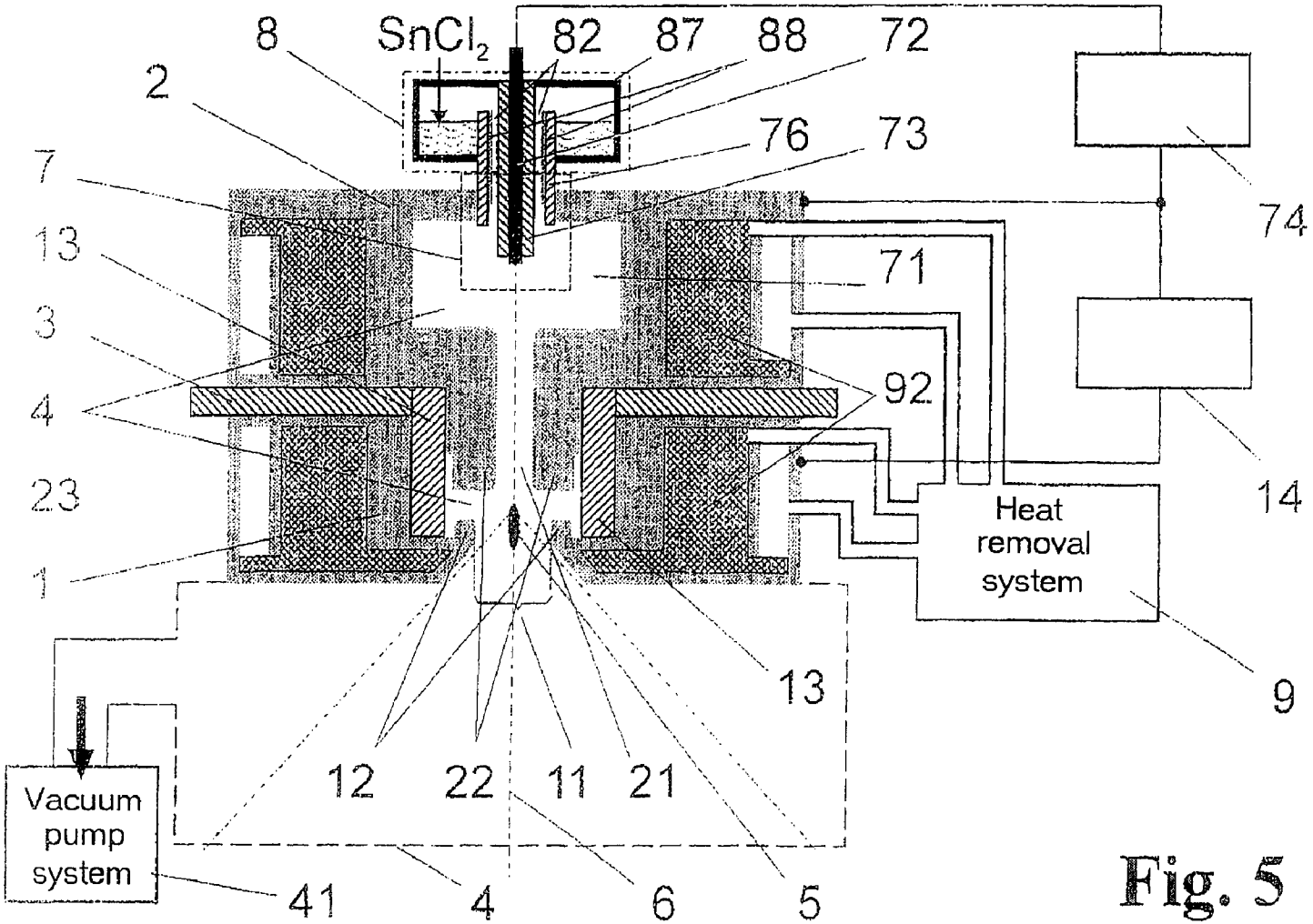
FIG. 5 shows another construction of the gas discharge source according to the invention with a gas preparation unit in the form of a cathode-side high-temperature gas inlet for solid tin-containing substances, particularly stannous chloride ($SnCl_2$).

FIG. 5 shows another embodiment example of the invention in which $SnCl_2$ is used as work medium. $SnCl_2$ is a crystalline white powder under standard conditions. This is deposited in the interior of a furnace 87 near the pre-ionization unit 7. Due to the fact that sufficiently high vapor pressures of about 133 Pa do not occur, depending upon material, until defined high temperatures are reached, the furnace 87 must be heatable up to such temperatures and adequately thermally insulated on the outside. A temperature of about 623° C. is sufficient for $SnCl_2$ and a temperature of approximately 114° C. is sufficient for $SnCl_4$, while a temperature of about 1400° C. is needed for metallic tin.

The $SnCl_2$ vapor is introduced into the pre-ionization chamber 71 in the cathode 2 through an annular gas inlet 82 between the insulator tube 73 of the pre-ionization electrode 72 and an external insulator tube 76. The outer insulator tube 76 is covered by a heat conduction layer 88 in the top part of its inner wall so that the vapor does not condense already before entering the pre-ionization chamber 71 of the cathode 2. This heat conduction layer 88 is a copper layer, for example, which is vacuum-deposited on the outer insulator tube 76. A heat conduction layer 88 of this kind can also be applied to the outer side of the inner insulator tube 73 to further reduce the cooling effect.

All of the other elements in this construction of the invention are arranged in the same manner as in the preceding example and correspond to the basic functions described with reference to FIG. 1.

While the foregoing description and drawings represent the present invention, it will be obvious to those skilled in the art that various changes may be made therein without departing from the true spirit and scope of the present invention.

REFERENCE NUMBERS

1 first electrode housing
11 outlet opening
12 (first) electrode collar
13 tubular insulator
14 high-voltage pulse generator
2 second electrode housing
21 narrowed outlet
22 (second) electrode collar
3 electrically insulating layer
31 vacuum insulation gap
4 vacuum chamber
41 vacuum pump system
5 plasma
51 emitted radiation
6 axis of symmetry
7 pre-ionization unit

71 pre-ionization chamber
72 pre-ionization electrode
73 insulator tube
74 pre-ionization pulse generator
75 sliding discharge
76 outer insulator tube
8 gas preparation unit
81 thermally insulated supply lines
82 gas inlet
83 thermal vessel
84 mass flow controller
85 gas reactor
86 inert-gas reservoir
87 furnace
88 metal coating
9 heat removal system
91 heat exchanger structure (ribs)
92 porous material

What is claimed is:

1. An arrangement for the generation of EUV radiation based on a gas discharge plasma with high radiation emission in the range between 12 nm and 14 nm comprising:

two coaxial electrode housings enclosing a vacuum chamber, a first of said electrode housings being provided as a discharge chamber for the gas discharge for plasma generation and a second electrode housing having a pre-ionization arrangement for the generation of an initial ionization of a work gas that is streamed into the vacuum chamber;

a narrowed electrode collar of the second electrode housing projecting into the first electrode housing;

a gas preparation unit being provided for defined control of the temperature and pressure of a tin-containing work medium and the flow thereof into the vacuum chamber in gaseous state; and at least one thermally insulated reservoir vessel and a thermally insulated supply line being provided for transferring the gaseous tin-containing work medium from the gas preparation unit to the pre-ionization unit located inside the electrode housings.

2. The arrangement according to claim 1, wherein the gas preparation unit has a thermal vessel for cooled holding of a liquefied work medium with a tin compound that is gaseous under normal conditions.

3. The arrangement according to claim 2, wherein the tin compound is stannane ($SnH_4$).

4. The arrangement according to claim 3, wherein the thermal vessel is adjustable to an internal temperature between −50° C. and −100° C.

5. The arrangement according to claim 2, wherein a reactor is provided for producing the gaseous, EUV-emitting tin compound and is connected to the cooled thermal vessel which serves to liquefy the gaseous tin compound and acts as a buffer storage.

6. The arrangement according to claim 1, wherein the gas preparation unit has, in addition, an inert-gas reservoir for mixing in an inert gas serving as an initiator for a homogeneous gas discharge of the gaseous tin compound.

7. The arrangement according to claim 6, wherein the inert-gas reservoir contains a noble gas in order to generate a gas mixture of gaseous tin compound and noble gas.

8. The arrangement according to claim 6, wherein the inert-gas reservoir contains nitrogen in order to generate a gas mixture of gaseous tin compound and nitrogen.

9. The arrangement according to claim 6, wherein at least one mass flow control unit is arranged in front of the gas inlet into the electrode housing for controlling the supplied quantity ratios of the gas mixture of gaseous tin compound and inert gas.

10. The arrangement according to claim 1, wherein the thermally insulated supply line for the gaseous work medium is connected to the second electrode housing by a gas inlet.

11. The arrangement according to claim 1, wherein the thermally insulated supply line for the gaseous tin-containing work medium is connected to the first electrode housing via an annular gas inlet.

12. The arrangement according to claim 1, wherein the gas preparation unit has a thermal vessel in the form of a thermally insulated furnace for evaporating a liquid tin compound.

13. The arrangement according to claim 12, wherein the furnace is used for storing in liquid state and evaporating a tin compound that is solid under normal conditions.

14. The arrangement according to claim 13, wherein the furnace is electrically heatable and has a thermostat for adjusting an evaporation temperature of the tin compound under vacuum conditions between 247° C. and 650° C.

15. The arrangement according to claim 13, wherein the tin compound is stannous chloride.

16. The arrangement according to claim 15, wherein the furnace can be heated to a temperature between 247° C. and 623° C. for evaporating $SnCl_2$ under vacuum conditions, wherein $SnCl_2$ is supplied to the furnace as crystalline powder.

17. The arrangement according to claim 12, wherein the furnace for the evaporated work medium is arranged in the immediate vicinity of the second electrode housing, and the gas inlet is connected directly to the pre-ionization unit.

18. The arrangement according to claim 17, wherein the gas inlet of the pre-ionization unit is designed in such a way that the evaporated tin compound is introduced into the pre-ionization chamber of the second electrode housing between an insulator tube enclosing the pre-ionization electrode and an outer insulator tube of the pre-ionization unit.

19. The arrangement according to claim 18, wherein a heat-conducting layer is arranged in the gas inlet at least in the initial area of the outer insulator tube.

20. The arrangement according to claim 19, wherein a heat-conducting layer is also arranged in the gas inlet on the insulator tube.

* * * * *